US007115011B2

(12) United States Patent
Chen

(10) Patent No.: US 7,115,011 B2
(45) Date of Patent: Oct. 3, 2006

(54) SWIM FIN

(76) Inventor: Chien-Kuan Chen, 4F., No.20,Lane46,Shihdong Rd., Shihlin District, Taipei City 111 (TW)

( * ) Notice: Subject to any disclaimer, the term of this patent is extended or adjusted under 35 U.S.C. 154(b) by 0 days.

(21) Appl. No.: 11/188,720

(22) Filed: Jul. 26, 2005

(65) Prior Publication Data

US 2006/0025027 A1 Feb. 2, 2006

Related U.S. Application Data

(63) Continuation-in-part of application No. 10/902,043, filed on Jul. 30, 2004, now abandoned.

(51) Int. Cl.
*A63B 31/08* (2006.01)

(52) U.S. Cl. ..... 441/64

(58) Field of Classification Search ..... 441/61, 441/62, 63, 64

See application file for complete search history.

(56) References Cited

U.S. PATENT DOCUMENTS 1,607,857 A * 11/1926 Zukal ..... 441/64
3,422,470 A * 1/1969 Lodovico ..... 441/64
6,955,575 B1 * 10/2005 Hsieh ..... 441/64

* cited by examiner

*Primary Examiner*—Lars A. Olson
(74) *Attorney, Agent, or Firm*—Troxell Law Office, PLLC

(57) ABSTRACT

An improved swim fin comprises a foot-packet formation formed with a foot-receiving cavity, and a fin blade attached and extending longitudinally beyond the foot-packet formation to a trailing edge thereof for a substantial length. The fin blade has an imaginary center line splitting down the middle thereof to separate the same into two symmetric portions. The fin blade further comprises: at least a first movable member and at least a second movable member. Both of the movable members are triangular shaped. The first movable member is disposed on one of the two portions of the fin blade and is connected to the fin blade by a first connecting edge such that the first movable member can wiggle using the first connecting edge as pivot within a predefined angle. The second movable member is disposed on another portion of the fin blade and is connected to the fin blade by a second connecting edge such that the second movable member can wiggle using the second connecting edge as pivot within an predefined angle.

13 Claims, 12 Drawing Sheets

SWIM FIN

The application is a continuation-in-part application of U.S. Ser. No. 10/902,043 filed on Jul. 30, 2004 now abandoned.

BACKGROUND OF INVENTION

1. Field of the Invention

The present invention relates to a swim fin, and more particularly, to a swim fin having at least a pair of movable members disposed on the fin blade thereof.

2. Description of the Prior Art

Swim fins substantially increase the surface area of a swimmer's foot thereby to increase force exerted by the foot on the water when swimming. Such fins generally include a foot-packet formation defining a foot-receiving cavity and a fin blade extending longitudinally beyond a user's foot for a substantial length. However, conventional swim fins currently available on the market all posses some kinds of imperfection in their fin blade design that require to be improved.

The swim fin as disclosed in R.O.C. Pat. 348543 includes a foot-packet formation and a fin blade, wherein the fin blade is integrally formed and is connected to the foot-packet formation by an inclination angle. In addition, both the upper and lower surfaces of the fin blade have a plurality of ribs disposed thereon for directing water flow with respect to the blade surface. As illustrated in R.O.C. Pat. 348543, the swim fin uses repulsive force exerted on the fin blade by water flow to create propulsion while the water flow also exerts drags to the same due to the formation of turbulence around the fin blade. Therefore, conventional swim fins generally can not have satisfactory propulsion efficiency.

Moreover, the swim fin as disclosed in R.O.C. Pat. 427172 includes a foot-packet formation and a fin blade, wherein the fin blade have two outward-inclined side rails and a inward-curled trailing edge. The two side rails and the trailing edge along with the bottom of the blade forms a spoon-like structure that can bags water therein to enable the two side rails to expand outwardly for increasing the amount of water pressured by the same and the operating surface thereof during a kicking stroke. In addition, the counter action of the kicking stroke will enable the two side rails to shrink inwardly for reducing resistance. However, the swim fin of R.O.C. Pat. 427172 still can not solve the problem of the drag exerting on the blade by water flow.

In addition, the swim fins as disclosed in R.O.C. Pat. 422117, U.S. Pat. No. 5,746,631 and U.S. Pat. No. 6,050,868 are unconventional paddle-like swim fins. These swim fins each comprises a foot-packet formation and a fin blade, wherein the fin blade further comprises a plurality of recesses incorporated thereon for directing water flow and two stiffening members arranged respectively at two sides of the fin blade. The fin blade is split down the middle, so it forms a left blade half and a right blade half that are symmetric with respect to each other. This special blade shape, when kick under water, creates propulsion by generating a pressure differential above and below the blade, in addition to the repulsive force created by kicking such that the swim fin can have better propulsion efficiency. However, the overall structural integrity of the forgoing swim fin is not strong enough to endure a long-hour and frequent usage that it is easy to deform.

In view of the above description, if a conventional swim fin has a good structural integrity, it will suffer a poor propulsion efficiency. On the other hand, if a conventional swim fin can create a pressure differential in the water flow to achieve satisfactory performance, it will suffer a poor structural integrity. In this regard, an improved swim fin is required.

U.S. Pat. No. 1,607,857 discloses a prior art swim fin that uses ribs to support a webbing to form a fin structure. The ribs are pivotally connected to a swivel plate and can pivot together with the webbing so as to provide the function of swim fin. However, since the webbing is merely supported by the ribs only, therefore, if the ribs of U.S. Pat. No. 1,607,857 are removed, then the webbing will lose its support and cannot provide the function of swim fin anymore.

U.S. Pat. No. 3,422,470 discloses a prior art swim fin 9 that comprises two rectangular flaps 91 formed on the web 92 thereof as shown in FIG. 9. The web 92 is formed with a longitudinal stiffening rib which is extending along a middle line 93 of the swim fin 9. The rectangular flaps 91 are located at two sides of the middle line 93 and are formed by means of U-shaped through slots 94. Since the two rectangular flaps 91 are symmetric and have the same distance between the trailing edge 95 and the flaps 91, the water flows 961, 962, 963 passing through the flaps 91 will be substantially parallel to the middle line 93 or even dispersed out from the middle line 93 as shown in FIG. 9. As a result, the efficiency and propulsion of the prior art swim fin 9 is also dispersed.

SUMMARY OF INVENTION

The primary object of the present invention is to provide an improved swim fin having at least a pair of triangular shaped movable members disposed on the fin blade thereof. Such that, when kicked under water, the movable members are capable of wiggling independently and respectively so as to generate more lift by enhancing more water to be project from the trailing edge of the fin blade thereof. Moreover, the movable members are capable of reducing the drag and turbulence exerting on the same by the water flow which will reduce the diver's fatigue and subsequently extend the swimming time and range.

The second object of the invention is to provide an improved swim fin with a preferred structural integrity achieved by incorporating the moving members on the surface of the fin blade along with providing a plurality of ribs on the same surface. Such that, the swim fin of the present invention can sustain a long-hour and frequent usage without deformation during usage.

To achieve the abovementioned objectives, the present invention provides an improved swim fin, comprising:

a foot-packet formation, defining a foot-receiving cavity; and a fin blade, attached and extending longitudinally beyond the foot-packet formation to a trailing edge thereof for a substantial length, and with an imaginary center line splitting down the middle thereof to separate the same into two symmetric portions.

Wherein, the fin blade further comprises at least a first movable member and at least a second movable member. Both of the moveable members are triangular shaped. The first movable member is disposed on one of the two portions of the fin blade and is connected to the fin blade by a first connecting edge as axle within a predefined angle The second movable member is disposed on another portion of the fin blade and is connected to the fin blade by a second connecting edge such that the second movable member can pivot using the second connection edge as axle within a predefined angle.

BRIEF DESCRIPTION OF THE DRAWINGS

The details of the present invention will be more readily understood from a detailed description of the preferred embodiments taken in conjunction with the following figures.

DETAILED DESCRIPTION

The improved swim fin of the present invention has at least a pair of movable members disposed on the fin blade thereof that, when kicked under water, are capable of wiggling independently and respectively so as to generate more lift by enhancing more water to be projected from the trailing edge of the fin blade. In the same time, these movable members are capable of reducing the drag and turbulence exerting on the same by the water flow. In addition, the swim fin of the present invention further has a plurality of ribs for enabling the same to have a better structural integrity.

Figure 1A:
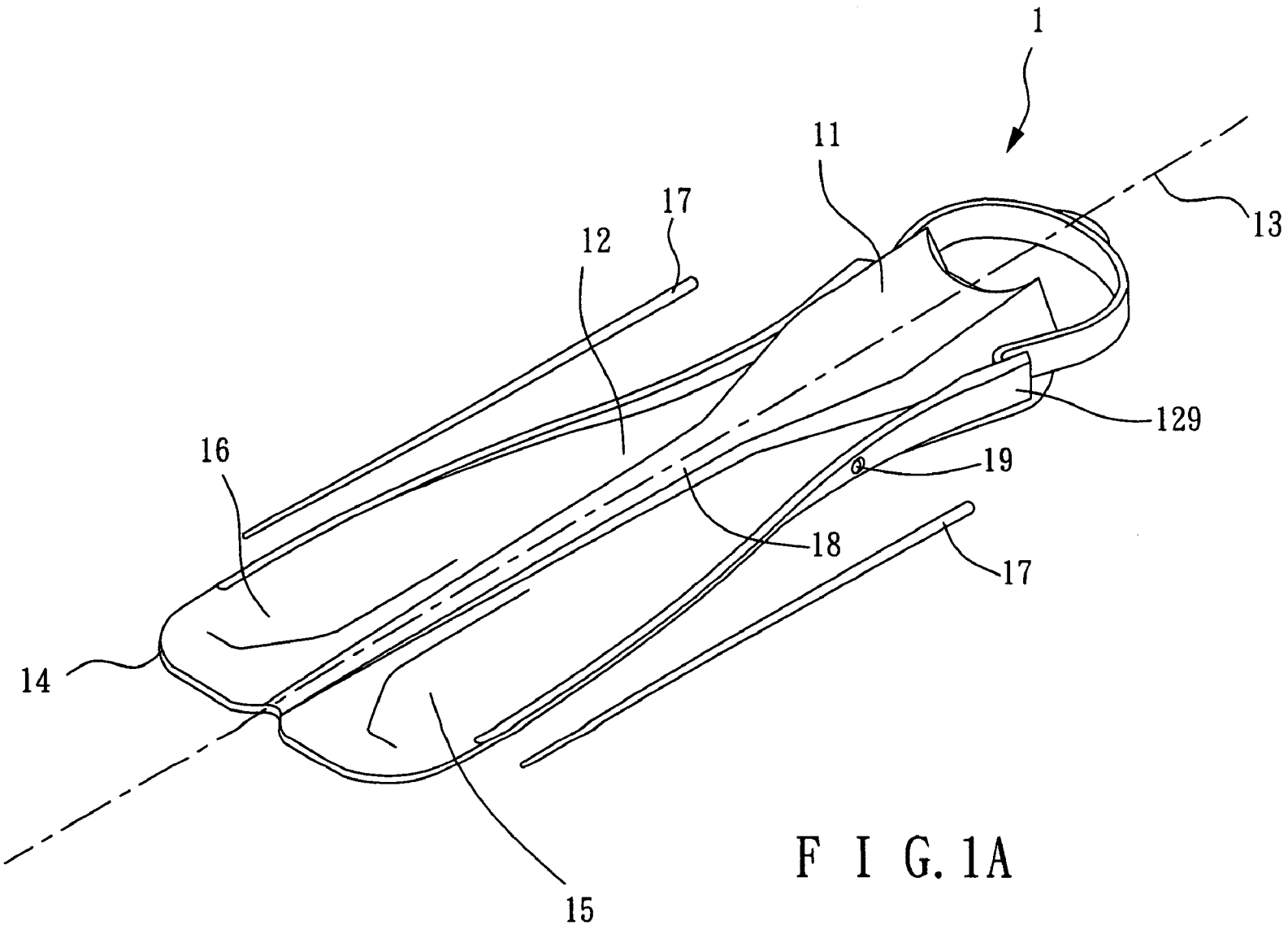
FIG. 1A is a 3-D diagram showing an improved swim fin with one movable member incorporated on a portion thereof respectively according to a preferred embodiment of the present invention.
Figure 1B:
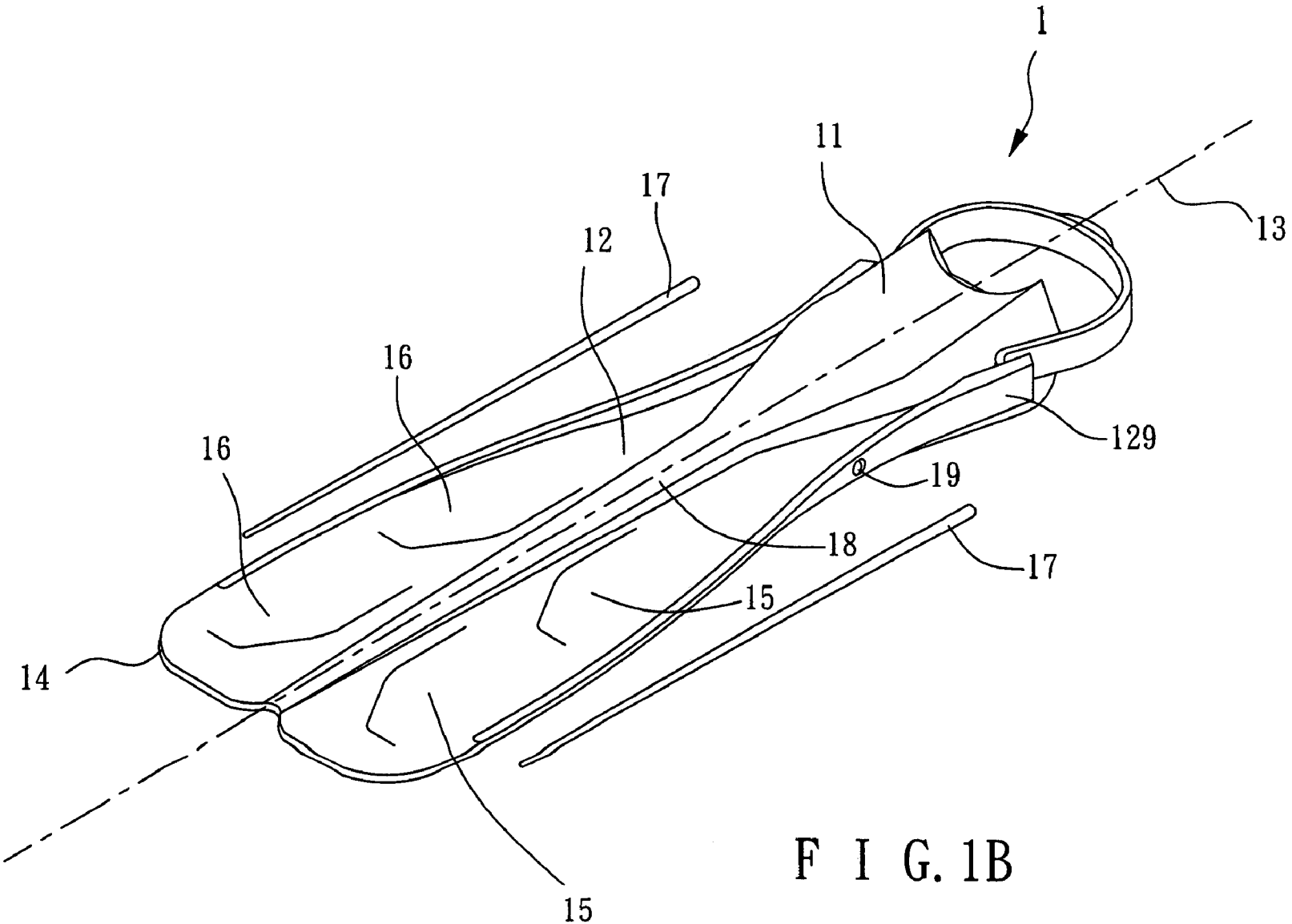
FIG. 1B is a 3-D diagram showing an improved swim fin with a plurality of movable members incorporated on a portion thereof respectively according to another preferred embodiment of the present invention.

Please refer to FIG. 1A and FIG. 1B, which are two preferred embodiments of the present invention. The improved swim fin 1 of the present invention comprises a foot-packet formation 11 formed with a foot-receiving cavity, and a fin blade 12 attached and extending longitudinally beyond the foot-packet formation 11. The swim fin 1 can be made of any material with suitable flexibility or pliability, such as plastic, neoprene rubber or other compounds, that is capable of enabling the fin blade 12 to have sufficient flexibility for swinging under water during a kicking stroke so as to produce a greater lift around the center front of the fin blade 12. In addition, the fin blade 12 is attached and extending longitudinally beyond the foot-packet formation 11 to a trailing edge 14 for a substantial length, and is split along an imaginary center line 13 down the middle thereof to separate the same into two symmetric portions. One portion of the fin blade 12 comprises at least a first movable member 15 and the other portion comprises at least a second movable member 16. The first and second movable members 15 and 16 are symmetrically distributed with respect to the imaginary center line 13 as seen in FIG. 1A and FIG. 1B. A plurality of movable members can be incorporated respectively in each portion of the fin blade 12. In addition, any of the embodiments and individual variations discussed above and hereafter may be interchanged and combined with one another in any desirable order, amount and configuration. Accordingly, the scope of the present invention should not be determined by the embodiments illustrated.

The standard flat fin usually suffers insufficient structural strength and integrity that can be deformed during usage. Thus, in a preferred embodiment of the present invention, the fin blade 12 further comprises two openings 19 and two removable side ribs 17. Each of the two openings 19 is formed on an outer edge 191 of the fin blade 12 for inserting one side rib 17 in a removable manner. The outer edge 191 is structured as a rib with a hollow center and is thicker than other parts of the fin blade 12 for providing structural strength of the swim fin 1. When there is a need to increase the structural strength and integrity, the side ribs 17 are inserted into outer edges 191 through the openings 19. And, when there is no need to increase the structural strength and integrity, for example, the swimmer prefer to use a more flexible swim fin, then these side ribs 17 can be removed from the openings 19, and the fin blade 12 is still functional for swim fin operation without the side ribs 17.

Moreover, a center rib 18 extruding out of the fin blade 12 is disposed along the imaginary center line 13 that has a width of 2w, where w is measured from the center line 13 to an edge of the center rib 18.

Figure 2A:
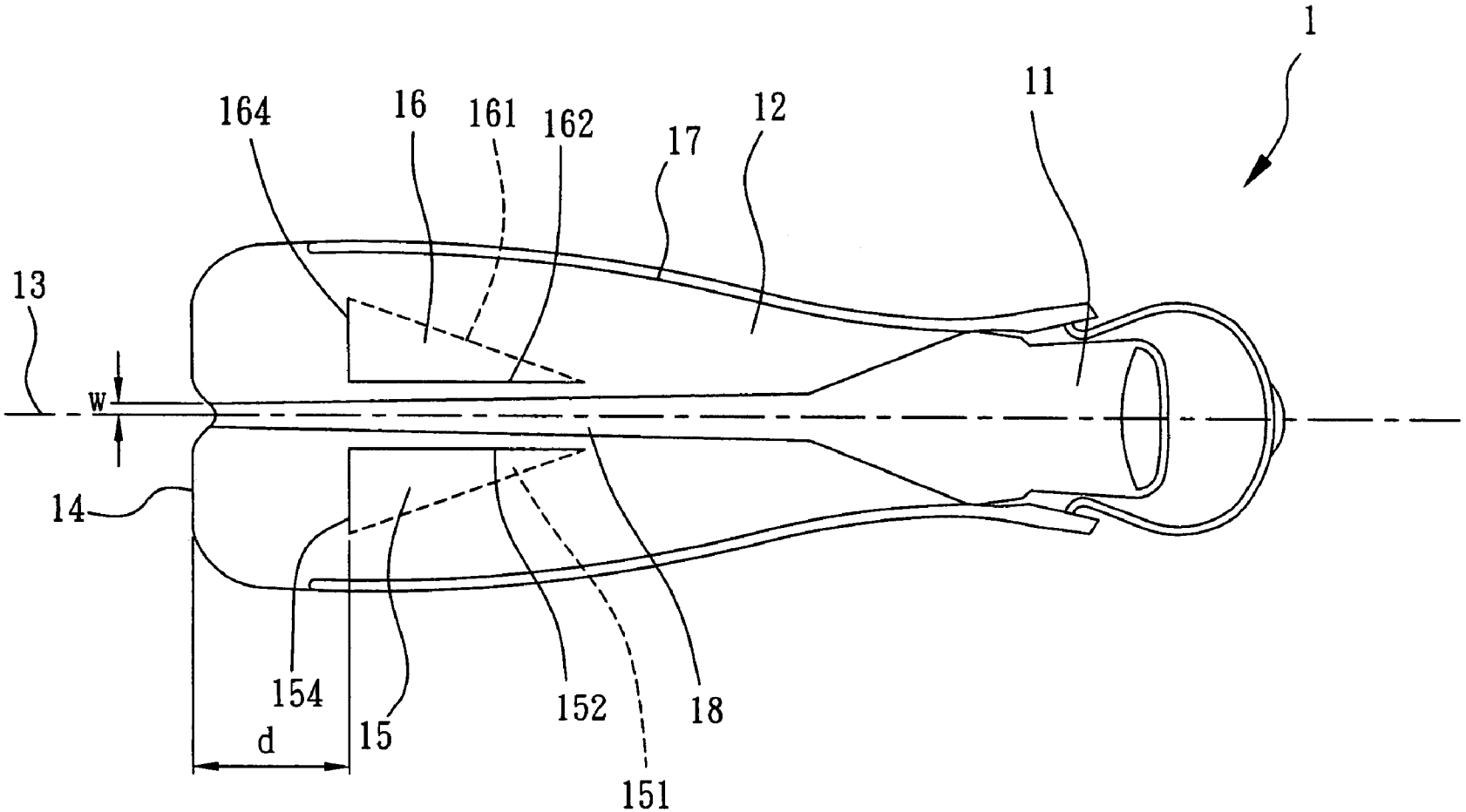
FIG. 2A is a top view of an improved swim fin according to the first preferred embodiment of the present invention.

Please refer to FIG. 2A~FIG. 2D, which are top views of several different preferred embodiments of the present invention. Within those preferred embodiments, most components are the same or similar to those of the previously illustrated embodiment. For clarity, since the other preferred embodiments hereinafter will have similar or the same components of the foregoing embodiment, therefore, for those same components without giving further detail will be given the same denomination and numbering, and for those similar components will add an English character to the original numbering for distinction. As seen in FIG. 2A, the first movable member 15 is incorporated at one of the two portions of the fin blade 12 split by the center line 13 which has a first longitudinal edge 152 and a first leading edge 154. Wherein, an end of the first longitudinal edge 152 is connected to an end of the first leading edge 154, and the first longitudinal edge 152 is placed in a vicinity of the center line 13 and the first leading edge 154 is placed away from the trailing edge 14 of the fin blade 12 by a predefined first distance d. In addition, since the first movable member 15 is formed integrally with the fin blade 12, an imaginary connecting line referred as first connecting line 151 (as the dotted line of FIG. 2A) with one end connected to the first longitudinal edge 152 and the other end connected to the first leading edge 154 is considered as a means for connecting the first movable member 15 with the fin blade 12. Hence, when the first movable member 15 subjects to an external force, the first movable member 15 can wiggle using the first connecting edge 151 as pivot.

The second movable member 16 is incorporated at another portion of the fin blade 12 opposite to the first movable member 15. The second movable member 16 also has a second longitudinal edge 162 and a second leading edge 164. Wherein, an end of the second longitudinal edge 162 is connected to an end of the second leading edge 164, and the second longitudinal edge 162 is placed in a vicinity of the center line 13 and the second leading edge 164 is placed away from the trailing edge 14 of the fin blade 12 by a predefined second distance d. In addition, since the second movable member 16 is formed integrally with, the fin blade 12, an imaginary connecting line referred as second connecting line 161 (as the dotted line of FIG. 2A) with one end connected to the second longitudinal edge 162 and the other end connected to the second leading edge 164 is considered as a means for connecting the second movable member 16 with the fin blade 12. Hence, when the second movable member 16 subjects to an external force, the second movable member 16 can wiggle using the second connecting edge 161 as pivot.

Figure 2B:
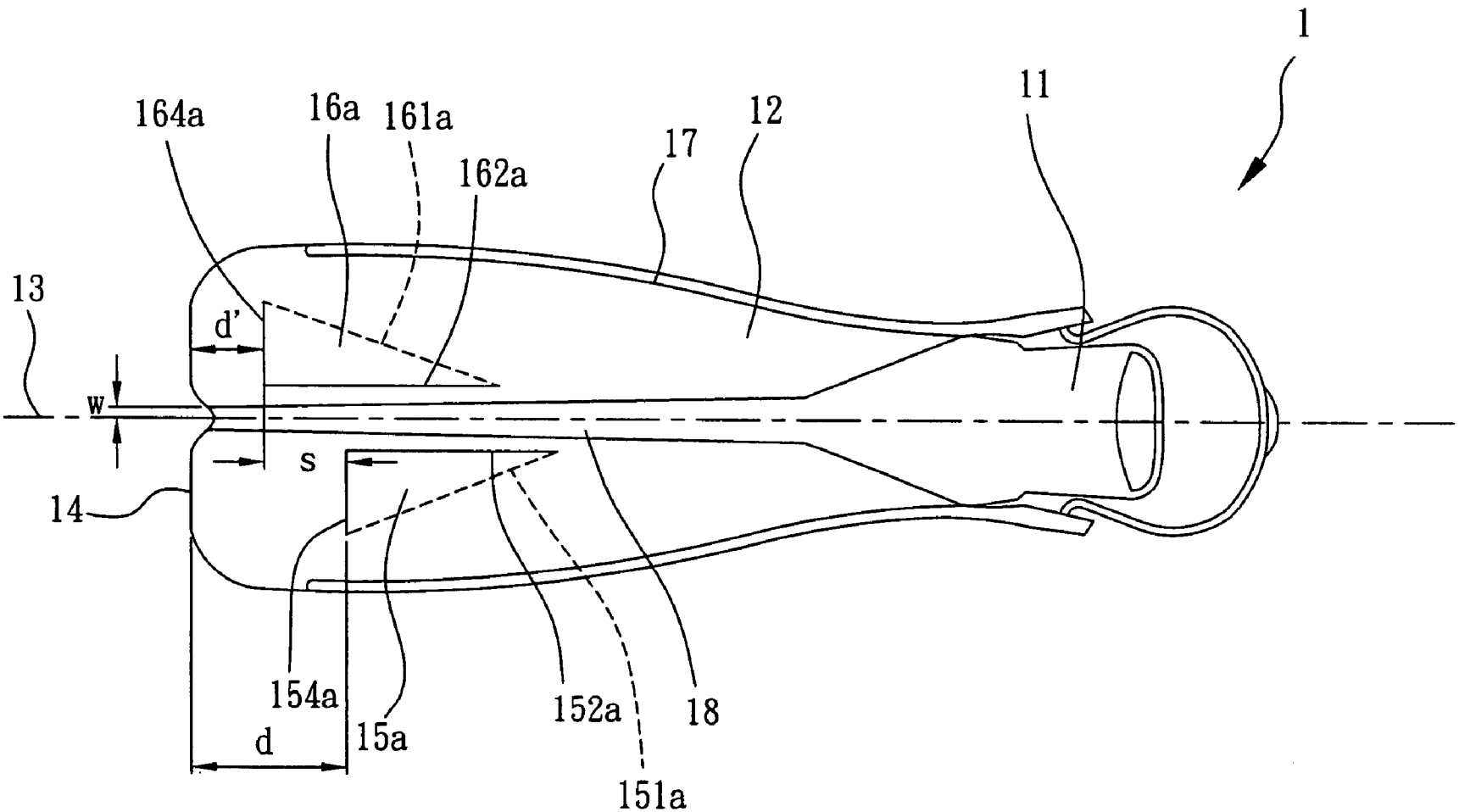
FIG. 2B is a top view of an improved swim fin according to the second preferred embodiment of the present invention.

Please refer to FIG. 2B, which shows another preferred embodiment having a second leading edge 164*a* of the second movable member 16*a* being away from the trailing edge 14 by a second distance d' which is different from the first distance d of the first leading edge 154*a* of the first movable member 15*a*. That is, the first leading edge 154*a* is positioned behind the second leading edge 164*a* by a distance s. Such kind of novel design makes the second movable member 16*a* being nearer to the trailing edge 14 than the first movable member 15*a*. Such that, when the swim fin 1 shown in FIG. 2B is kicked through the water, the wiggly angles of the first and second movable members 15*a* and 16*a* will be different. Not only the amount of water flowing through the first and second movable members 15*a* and 16*a* will be different, but also the water flows will be directed toward a direction which is not parallel with the imaginary center line 13. For a swim fin 1 as shown in FIG. 2B, since the second movable member 16*a* is located closer to the trailing edge 14 and is subjected to larger pressure during a water stroke, more water will pass through the second movable member 16*a* than the first movable member 15*a*, and thus result in the water to substantially flow toward the first movable member 15*a* in a inclined manner but not parallel to the middle line 13.

Figure 2C:
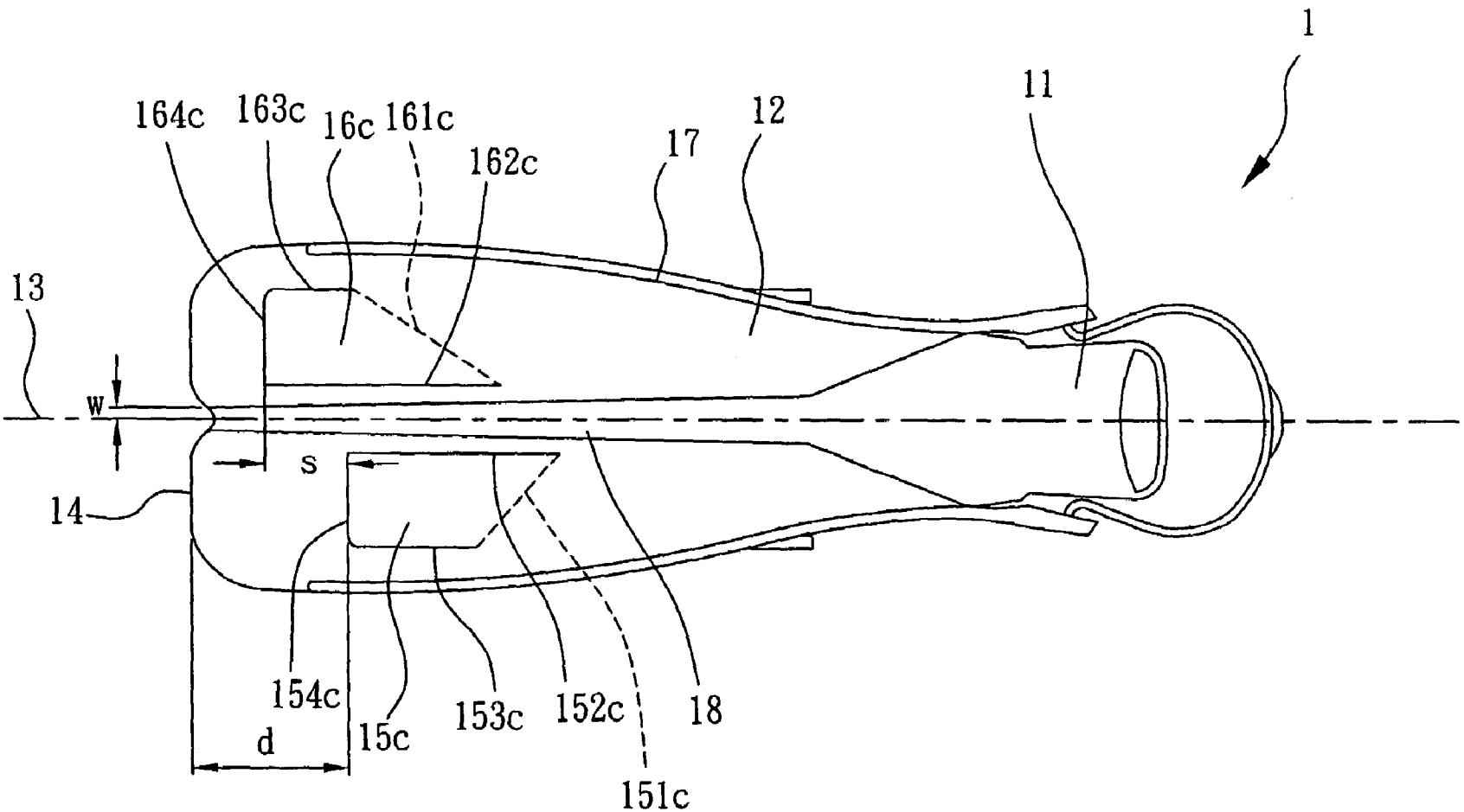
FIG. 2C is a top view of an improved swim fin according to the third preferred embodiment of the present invention.

Please refer to FIG. 2C, the movable member 15*c* of the preferred embodiment has a first side edge 153*c* in addition to the first longitudinal edge 152*c* and the first leading edge 154*c* similar to those of FIG. 2B. Moreover, instead of connecting an end of the first leading edge 154*c* to the first longitudinal edge 152*c* by dotted first connecting edge 151*c* as those of FIG. 2B, the end of the first leading edge 154*c* is first connected to an end of the first side edge 153*c* whose another is then connected to the first longitudinal edge 152*c* by the dotted first connecting edge 151*c*. As seen in FIG. 2C, the three edges 152*c*, 153*c* and 154*c* substantially forms a U shape and the length of the first longitudinal edge 152*c* is larger than that of the first side edge 153*c*. The first longitudinal edge 152*c* is placed away from the trailing edge 14 of the fin blade 12 by a predefined distance d. In addition, since the first movable member 15*c* is formed integrally with the fin blade 12, an imaginary connecting line referred as first connecting line 151*c* (as the dotted line of FIG. 2C) with one end connected to the first longitudinal edge 152*c* and the other end connected to the first side edge 153*c* is considered as a means for connecting the first movable member 15*c* with the fin blade 12. Hence, when the first movable member 15*c* subjects to an external force, the first movable member 15*c* can wiggle using the first connecting edge 151*c* as pivot.

Figure 2D:
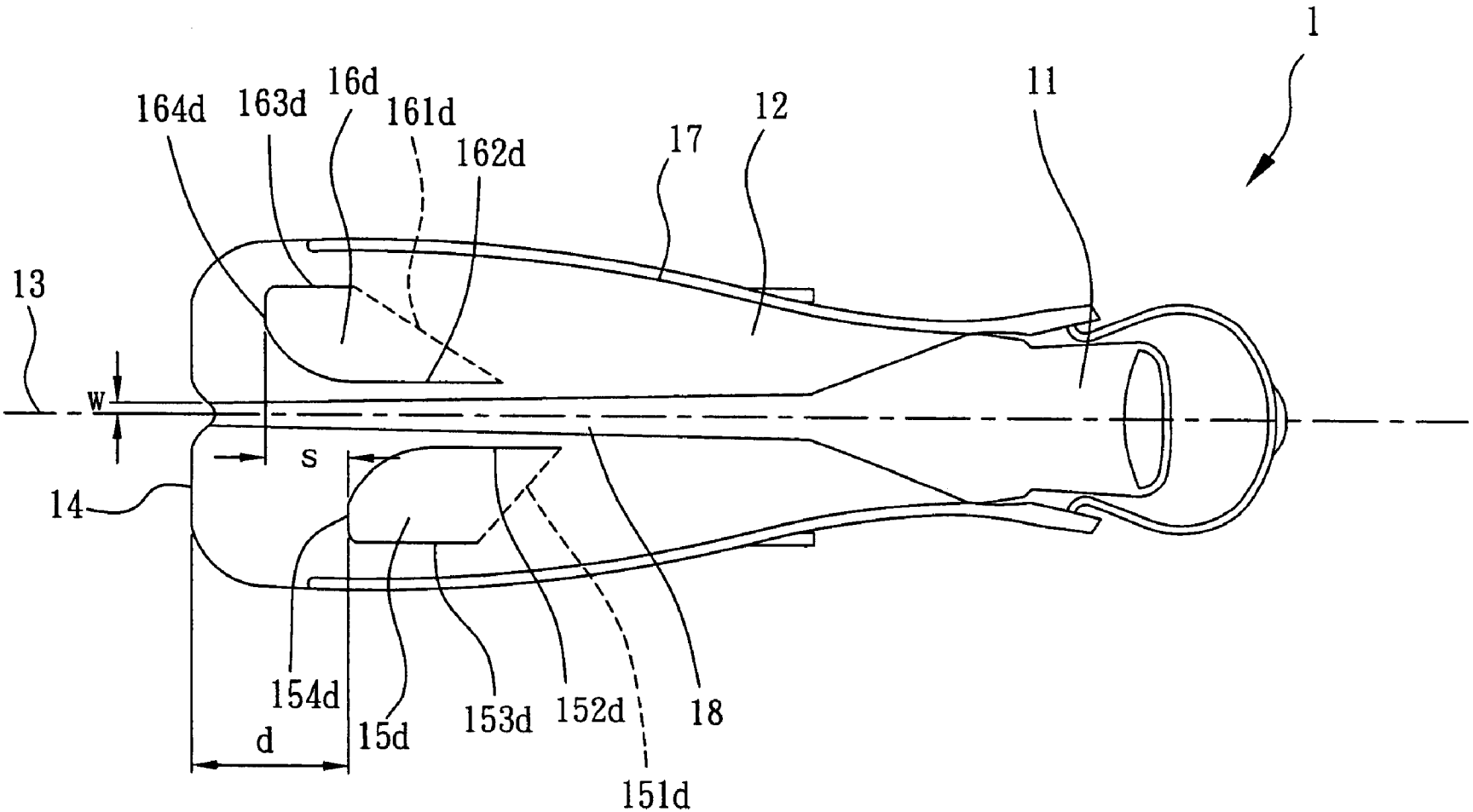
FIG. 2D is a top view of an improved swim fin according to the fourth preferred embodiment of the present invention.

The second movable member 16*c* is incorporated at another portion of the fin blade 12 opposite to the first moveable member 15*c*. The second movable member 16*c* also has a second longitudinal edge 162*c*, a second side edge 163*c* and a second leading edge 164*c*, together forming a U shape and the length of the second longitudinal edge 162*c* is larger than that of the second side edge 163*c*. The second longitudinal edge 162*c* is placed in the vicinity of the center line and the second leading edge 164*c* is placed away from the trailing edge 14 of the fin blade 12 by a predefined distance d. In addition, since the second movable member 16*c* is formed integrally with the fin blade 12, an imaginary connecting line referred as second connecting line 161*c* (as the dotted line of FIG. 2C) with one end connected to the second longitudinal edge 162*c* and the other end connected to the second side edge 163*c* is considered as a means for connecting the second movable member 16*c* with the fin blade 12. Hence, when the second movable member 16*c* subjects to an external force, the second movable member 16*c* can wiggle using the second connecting edge 161 as pivot. The first leading edge 154*c* and the second leading edge 164*c* are straight lines in FIG. 2C. However, as seen in FIG. 2*d*, the first leading edge 154*d* and the second leading edge 164*d* can also be arcs. The shape forms by the edges of the movable member can vary and are not limited by the foregoing embodiments.

Figure 3:
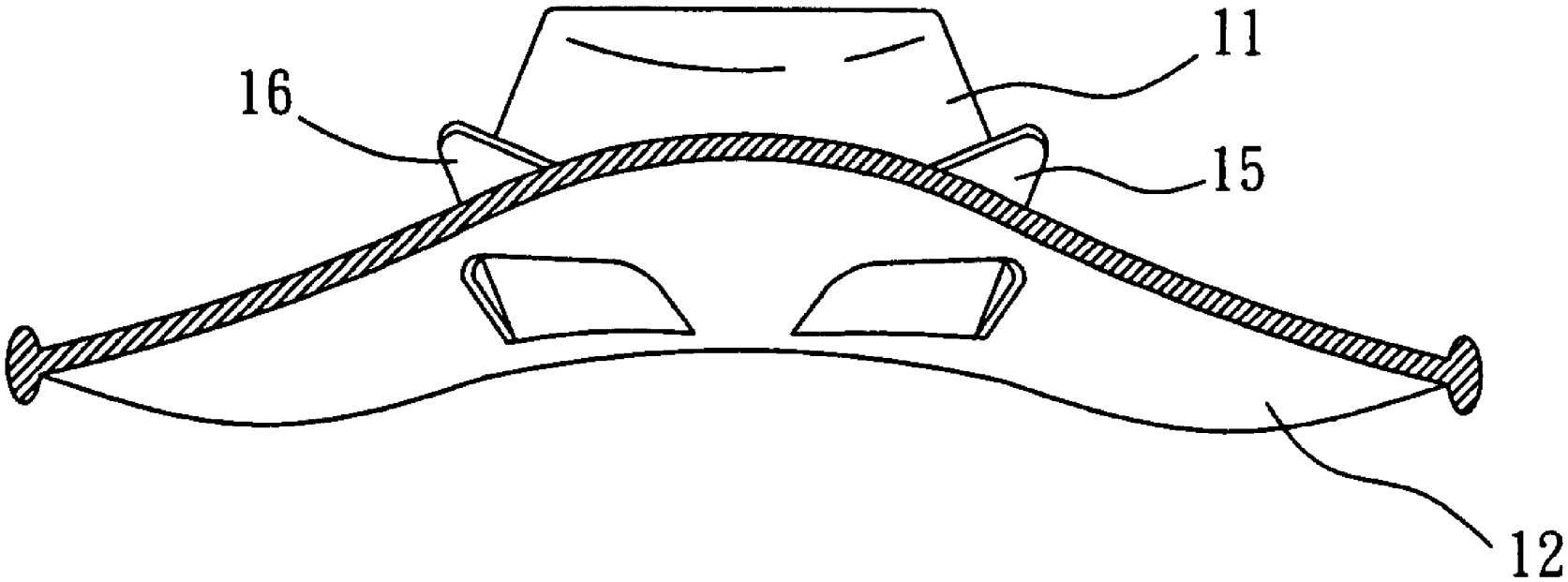
FIG. 3 is a sectional view showing an improved swim fin of the present invention.
Figure 4:
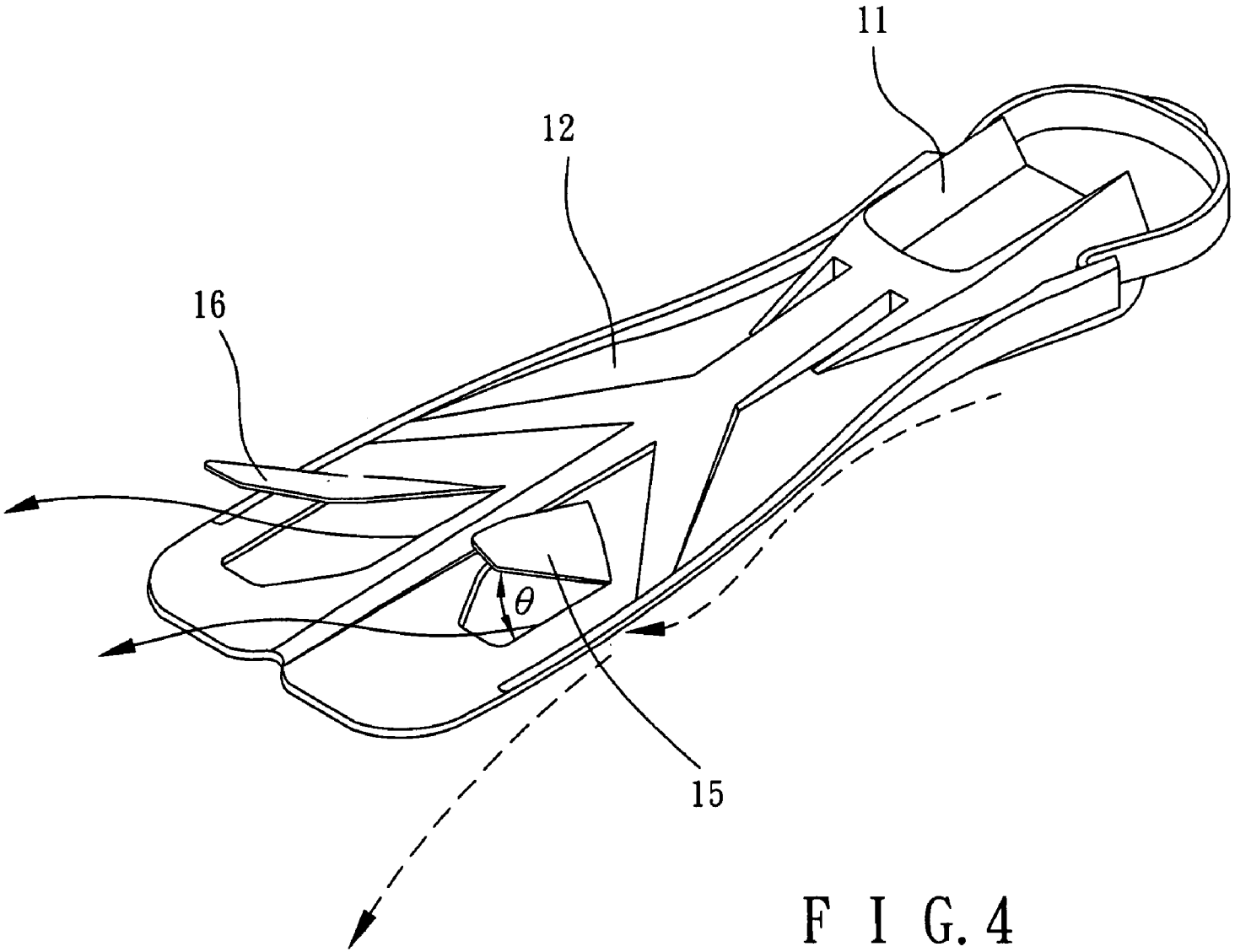
FIG. 4 shows the direction of water flow while an improved swim fin of the present invention is kicked through the water.

Please refer to FIG. 3 and FIG. 4, which respectively is a sectional view showing an improved swim fin and is a diagram showing the direction of water flow while the improved swim fin is kicked through the water. In a kicking stroke, both the first movable member 15 and second movable member 16 are turned to a direction counter to moving direction of the fin blade 12 and are pivoted by an angle θ. In general, since the first movable member 15 is closer to the center of a user than the second movable member 16, the first movable member 15 shall be turned faster than the second movable member 16. In addition, the pivot angle of the first movable member 15 shall be larger than that of the second movable member 16 so that water flow can be forced to concentrate at the center of the user. The splits formed by turning the first movable member 15 and the second movable member 16 allow the water to flow pass and thus be projected toward the trailing edge 14 so as to reduce the drag and turbulence exerting on the fin blade 12 by the water flow. In addition, the angle of attack is reduced while both the first and second movable members 15 and 16 are turned by an appropriate angle θ that can effectively increase the lift exerted on the fin blade 12.

The improved swim fin of the present invention having at least a pair of movable members and a plurality of ribs is capable of reducing the drag and turbulence exerting on the fin blade thereof, and the same time enhancing the structural integrity of the same. In this regard, the conventional shortcomings are overcome and the industry competitiveness is increased.

Figure 5:
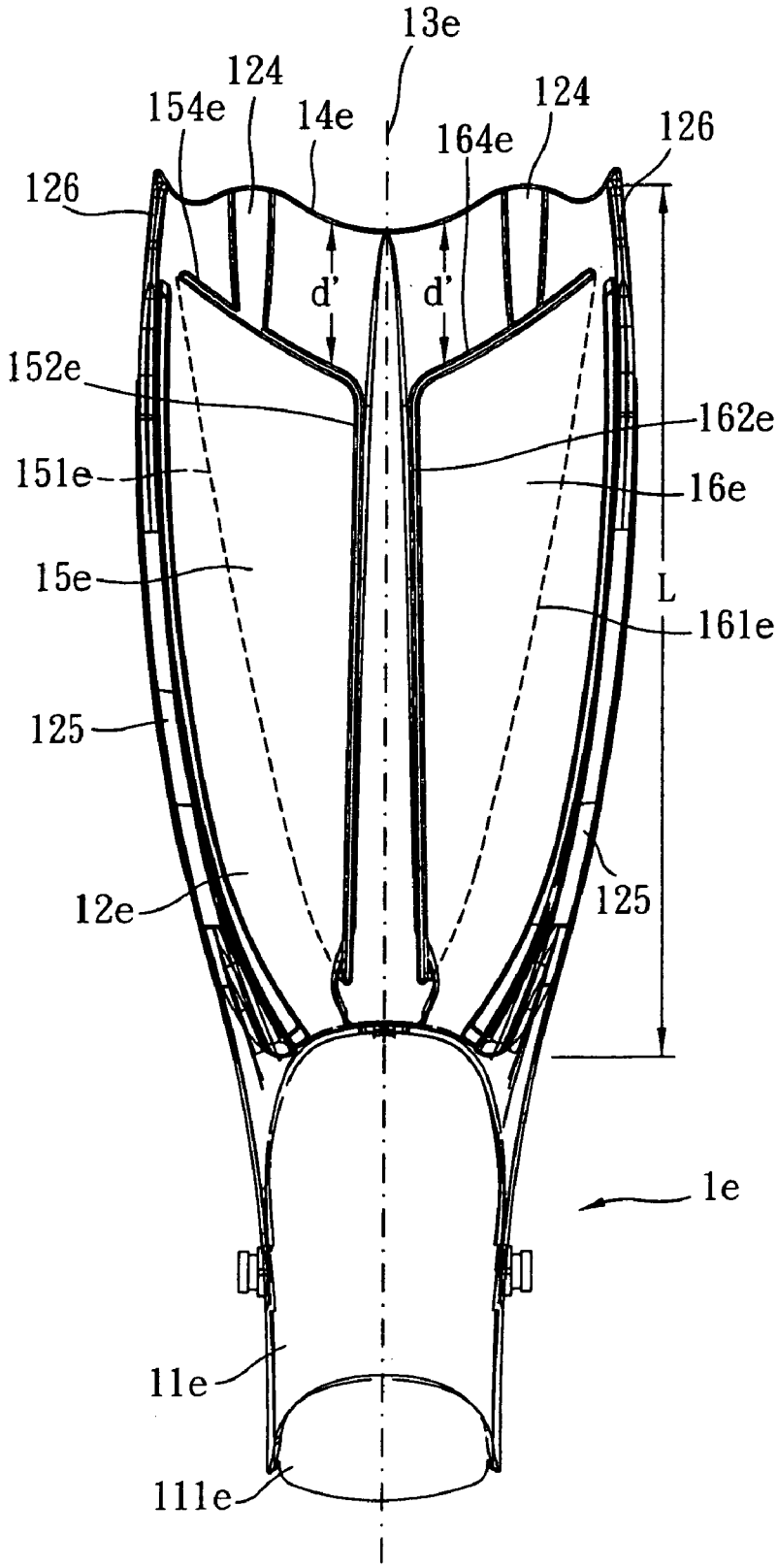
FIG. 5 is a top view of an improved swim fin according to the fifth preferred embodiment of the present invention.
Figure 6:
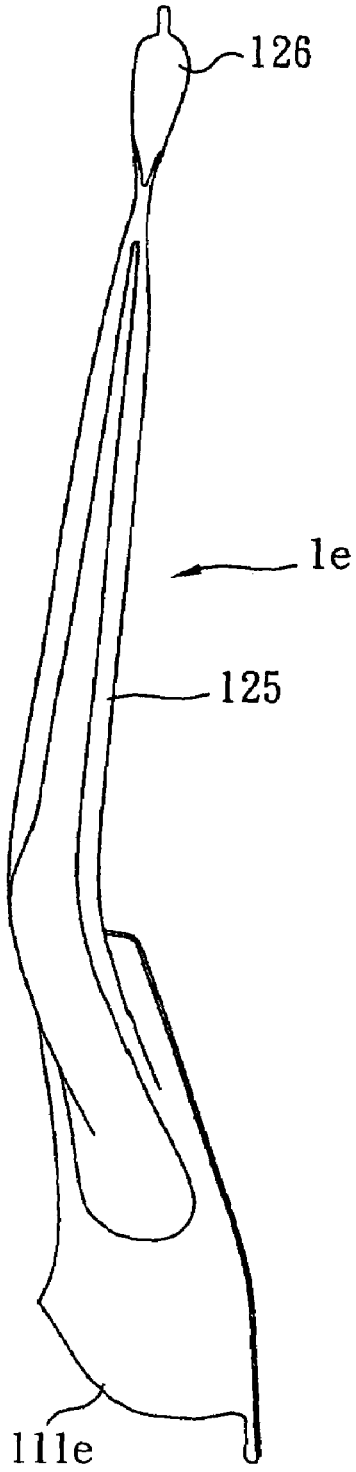
FIG. 6 is a side view of the improved swim fin as shown in FIG. 5.
Figure 7:
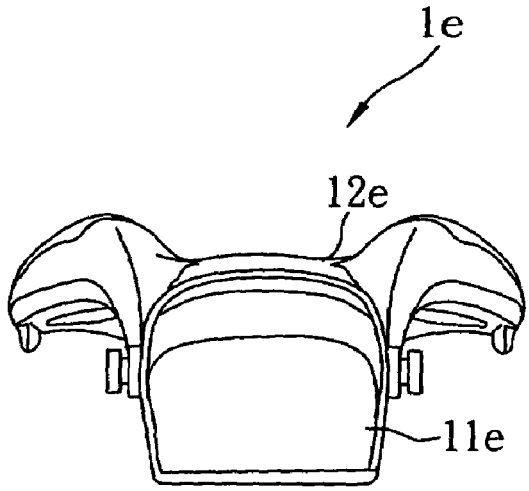
FIG. 7 is a front view of the improved swim fin as shown in FIG. 5.

Please refer to FIGS. 5~7, which illustrate the fifth preferred embodiment of the improved swim fin in accordance with the present invention. As shown in FIGS. 5~7, the improved swim fin 1*e* comprises: a foot-packet formation 11*e* and a fin blade 12*e*. The foot-packet formation 11*e* is formed with a foot-receiving cavity 111*e*. The fin blade 12*e* is attached to and extending longitudinally beyond the foot-packet formation 11*e* toward a trailing edge 14*e* thereof for a first length L. The fin blade 12*e* has an imaginary center line 13*e* splitting down the middle of the fin blade 12*e* and extending longitudinally so as to substantially separate the fin blade 12*e* into two symmetric portions.

The fin blade 12*e* further comprises at least a first movable member 15*e* and at least a second movable member 16*e*. The first movable member 15*e* is disposed on one of the two portions of the fin blade 12*e*. The first movable member 15*e* is triangular shaped and is defined by a first longitudinal edge 152*e*, a first leading edge 154*e* and a first connecting edge 151*e*. The first longitudinal edge 152*e* is located in a vicinity of the center line 13*e* and extends parallel to the center line 13*e*. The first leading edge 154*e* is located near to but spaced apart from the trailing edge 14*e* by a first distance d. The first longitudinal edge 152*e* and the first leading edge 154*e* both are through slots and are connected to each other at one end thereof. The first connecting edge 151*e* is an imaginary connecting line with one end connected to the first longitudinal edge 152*e* and the other end connected to the first leading edge 154*e* so as to form the triangular shaped first movable member 15*e*.

The second movable member 16*e* is disposed on another portion of the fin blade 12*e*. The second movable member 16*e* is triangular shaped and is defined by a second longitudinal edge 162*e*, a second leading edge 164*e* and a second connecting edge 161*e*. The second longitudinal edge 162*e* is located in a vicinity of the center line 13*e* and is extending parallel to the center line 13*e*. The second leading edge 164*e* is located near to but spaced apart from the trailing edge 14*e* by a second distance d' which is the same as the first distance d in this embodiment. The second longitudinal edge 162*e* and the second leading edge 164*e* both are through slots and are connected to each other at one end thereof. The second connecting edge 161*e* is an imaginary connecting line with one end connected to the second longitudinal edge 162*e* and the other end connected to the second leading edge 164*e* so as to form the triangular shaped second movable member 16*e*. In this embodiment, the second movable member 16*e* is substantially symmetric with the first movable member 15*e*.

As shown in FIGS. 5~7, one end of the first longitudinal edge 152*e* is located near to the foot-packet formation 11*e*, such that the first longitudinal edge 152*e* is substantially extending from the foot-packet formation 11*e* toward the trailing edge 14*e* in a direction parallel to the imaginary center line 13*e*. In this preferred embodiment, a length of the first longitudinal edge 152*e* is longer than ⅔ of the first length L of fin blade 12. Such kind of long first longitudinal edge 152*e* will make the first movable member 15*e* to wiggle more easily since the first movable member 15*e* will be more flexible in comparison with short one.

Each portion of the fin blade 12*e* is further formed with at least one guiding groove 124. The groove 124 is located on an upper surface of the fin blade 12*e* and is extending between the leading edge 154*e* and the trailing edge 14*e* for guiding water flows. In addition, the fin blade 12*e* has two longitudinal outer edges 125 extending between the foot-packet formation 11*e* and the trailing edge 14*e*. Each outer edge 125 has a thickness greater than that of the fin blade 12*e* for providing structural strength. Each outer edge 125 is further formed with a rudder 126 at one end adjoining the trailing edge 14*e* for guiding water flows.

Figure 8:
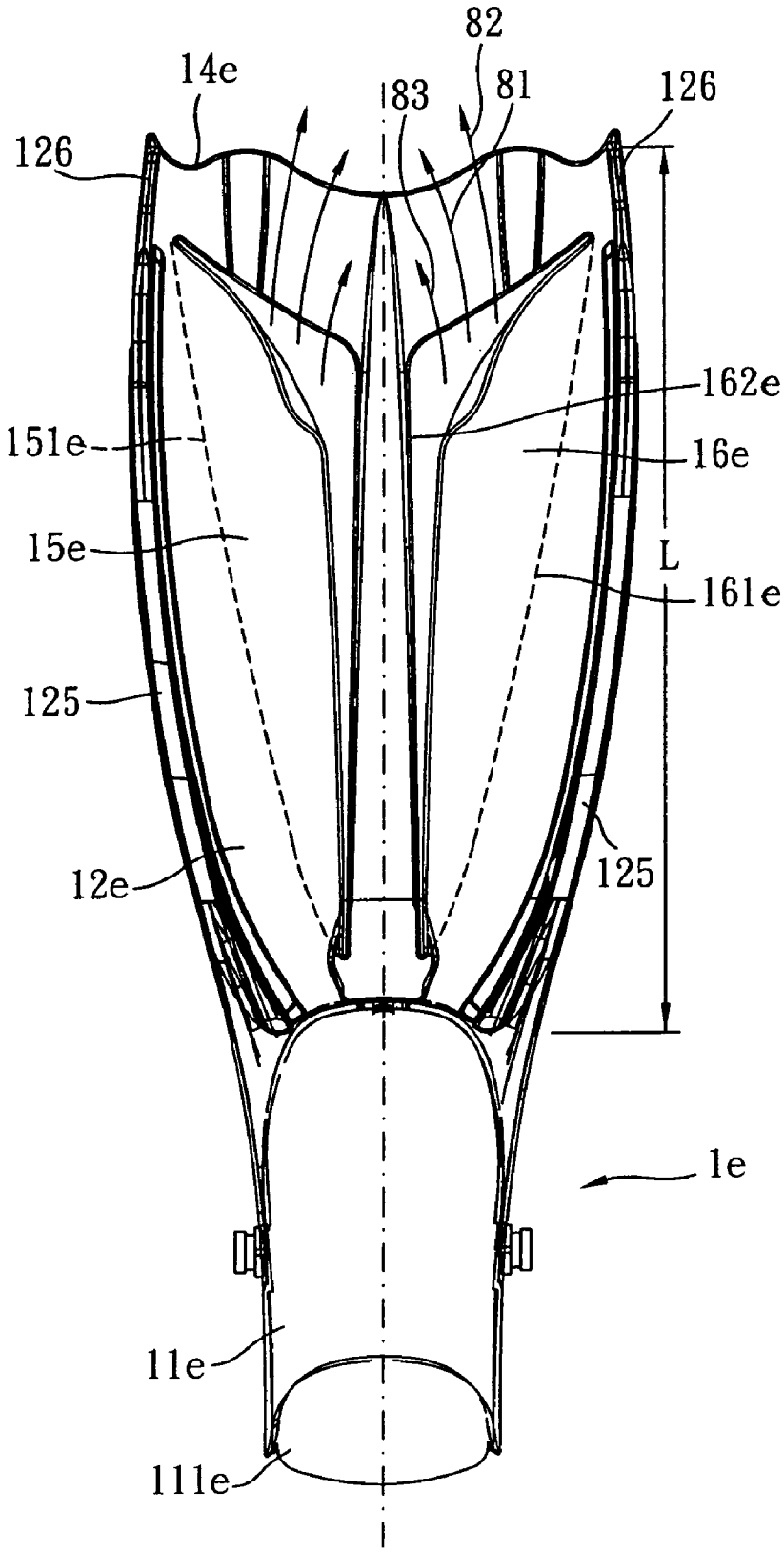
FIG. 8 is a schematic diagram showing the direction of water flows when the improved swim fin of FIG. 5 is kicked through the water.

Please refer to FIG. 8, which is a schematic diagram showing the direction of water flows when the improved swim fin 1*e* of FIG. 5 is kicked through the water. It can be seen that, when the swim fin 1*e* is kicked through the water, some of the water flows 81, 82, 83 will pass through the openings generated by the wiggling movable members 15*e*, 16*e*. Since the movable members 15*e*, 16*e* of the present invention are triangular shaped, these water flows 81, 82, 83 will substantially be condensed toward the middle line 13*e*. Moreover, by means of the novel design of guiding grooves 124 and rudders 126, these water flows 81, 82, 83 can be guided toward predefined directions so as to increase the propulsion and efficiency of the swim fin 1*e*. Furthermore, the rudders 126 can also stabilize the fin blade 12*e* when the swim fin 1*e* is kicked through the water.

Figure 9:
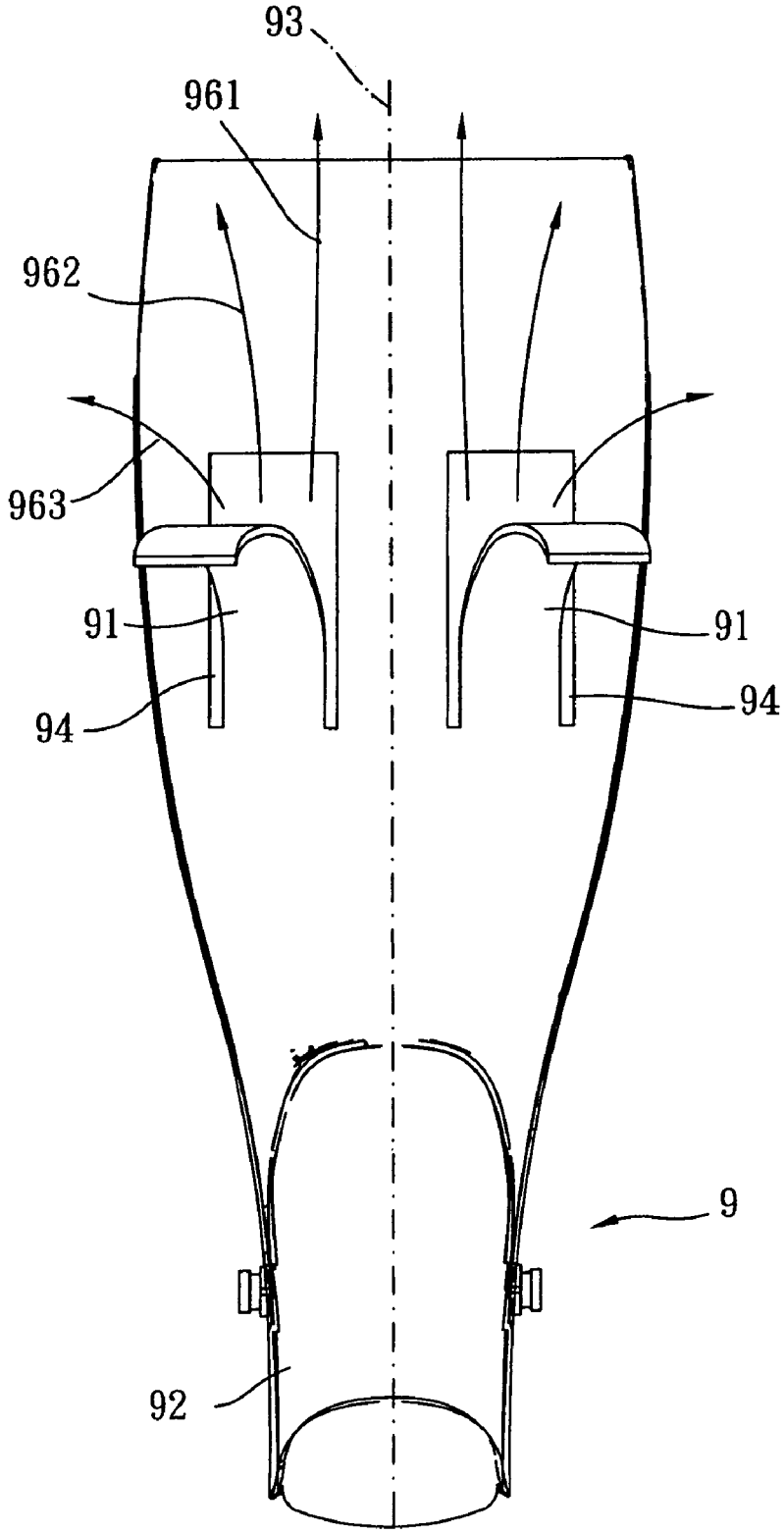
(PRIOR ART) F I G. 9
FIG. 9 is a schematic diagram showing the direction of water flows when a prior art swim fin of U.S. Pat. No. 3,422,470 is kicked through the water.

In comparison with the prior art swim fin 9 of U.S. Pat. No. 3,422,470 as shown in FIG. 9, it is clearly that the triangular shaped movable members 15*e*, 16*e* of the present invention as shown in FIG. 8 can condense the water flows 81, 82, 83 toward the middle line 13*e* but not to disperse them. Therefore, the triangular shaped movable members 15*e*, 16*e* of the present invention will be able to provide better propulsion and efficiency than that of the rectangular flaps 91 of U.S. Pat. No. 3,422,470.

While the preferred embodiments of the present invention have been set forth for the purpose of disclosure, modifications of the disclosed embodiments of the present invention as well as other embodiments thereof may occur to those skilled in the art. Accordingly, the appended claims are intended to cover all embodiments which do not depart from the spirit and scope of the present invention.

What is claimed is:

1. An improved swim fin, comprising:

a foot-packet formation formed with a foot-receiving cavity; and a fin blade attached and extending longitudinally beyond the foot-packet formation to a trailing edge thereof for a first length, said fin blade having an imaginary center line splitting down the middle of the fin blade and extending longitudinally so as to substantially separate the fin blade into two portions, said fin blade further comprising:

at least a first movable member disposed on one of the two portions of the fin blade, the first movable member is triangular shaped and is defined by a first longitudinal edge, a first leading edge and a first connecting edge, the first longitudinal edge being located in a vicinity of the center line and being substantially extending parallel to the center line, the first leading edge being located near to but spaced apart from the trailing edge by a first distance, the first longitudinal edge and the first leading edge both being through slots and being connected to each other at one end thereof, the first connecting edge being an imaginary connecting line with one end connected to the first longitudinal edge and the other end connected to the first leading edge so as to form the triangular shaped first movable member; and at least a second movable member disposed on another portion of the fin blade, the second movable member is triangular shaped and is defined by a second longitudinal edge, a second leading edge and a second connecting edge, the second longitudinal edge being located in a vicinity of the center line and being substantially extending parallel to the center line, the second leading edge being located near to but spaced apart from the trailing edge by a second distance, the second longitudinal edge and the second leading edge both being through slots and being connected to each other at one end thereof, the second connecting edge being an imaginary connecting line with one end connected to the second longitudinal edge and the other end connected to the second leading edge so as to form the triangular shaped second movable member;

wherein, the fin blade further comprises two openings and two side ribs, each of the two openings is formed on an outer edge of the fin blade for inserting one side rib in a removable manner; and, wherein, when the side ribs are inserted in the openings, structural strength of the fin blade is increased; when the side ribs are removed from the openings, the fin blade is still functional for swim fin operation but in a more flexible manner.

2. The swim fin of claim 1, wherein the first distance is different from the second distance.

3. The swim fin of claim 1, wherein one end of the first longitudinal edge is located near to the foot-packet formation, such that the first longitudinal edge is substantially extending from the foot-packet formation toward the trailing edge in a direction parallel to the imaginary center line.

4. The swim fin of claim 3, wherein a length of the first longitudinal edge is longer than ⅔ of the first length of fin blade.

5. The swim fin of claim 1, wherein each portion of the fin blade is further formed with at least one groove, the groove is located on an upper surface of the fin blade and is extending between the leading edge and the trailing edge for guiding water flows.

6. The swim fin of claim 1, wherein the fin blade has two longitudinal outer edges extending between the foot-packet formation and the trailing edge, each outer edge has a thickness greater than that of the fin blade for providing structural strength, each outer edge is further formed with a rudder at one end adjoining the trailing edge for guiding water flows.

7. An improved swim fin, comprising:

a foot-packet formation formed with a foot-receiving cavity; and a fin blade attached and extending longitudinally beyond the foot-packet formation to a trailing edge thereof for a first length, said fin blade having an imaginary center line splitting down the middle of the fin blade and extending longitudinally so as to substantially separate the fin blade into two portions, said fin blade further comprising:

at least a first movable member disposed on one fo the two portions of the fin blade, the first movable member is triangular shaped and is defined by a first longitudinal edge, a first leading edge and a first connecting edge, the first longitudinal edge being located in a vicinity of the center line, the first leading edge being located near to but spaced apart from the trailing edge, the first longitudinal edge and the first leading edge both being through slots and being connected to each other at one end thereof, the first connecting edge being an imaginary connecting line with one end connected to the first longitudinal edge and the other end connected to the first leading edge so as to form the triangular shaped first movable member;

at least a second movable member disposed on another portion of the fin blade, the second movable member is triangular shaped and is defined by a second longitudinal edge, a second leading edge and a second connecting edge, the second longitudinal edge being located in a vicinity of the center line, the second leading edge being located near to but spaced apart from the trailing edge, the second longitudinal edge and the second leading edge both being through slots and being connected to each other at one end thereof, the second connecting edge being an imaginary connecting line with one end connected to the second longitudinal edge and the other end connected to the second leading edge so as to form the triangular shaped second movable member;

at least one groove located on an upper surface of the fin blade and extending between one of the leading edges and the trailing edge for guiding water flows; and two longitudinal outer edges extending between the foot-packet formation and the trailing edge, each outer edge having a thickness greater than that of the fin blade for providing structural strength, each outer edge being formed with a rudder at one end adjoining the trailing edge for guiding water flows.

8. An improved swim fin, comprising:

a foot-packet formation formed with a foot-receiving cavity; and a fin blade attached and extending longitudinally beyond the foot-packet formation to a trailing edge thereof for a first length, said fin blade having an imaginary center line splitting down the middle of the fin blade and extending longitudinally so as to substantially separate the fin blade into two portions, said fin blade further comprising:

at least a first movable member disposed on one of the two portions of the fin blade, the first movable member is triangular shaped and is defined by a first longitudinal edge, a first leading edge and a first connecting edge, the first longitudinal edge being located in a vicinity of the center line and being substantially extending parallel to the center line, the first leading edge being located near to but spaced apart from the trailing edge by a first distance, the first longitudinal edge and the first leading edge both being through slots and being connected to each other at one end thereof, the first connecting edge being an imaginary connecting line with one end connected to the first longitudinal edge and the other end connected to the first leading edge so as to form the triangular shaped first movable member; and at least a second movable member disposed on another portion of the fin blade, the second movable member is triangular shaped and is defined by a second longitudinal edge, a second leading edge and a second connecting edge, the second longitudinal edge being located in a vicinity of the center line and being substantially extending parallel to the center line, the second leading edge being located near to but spaced apart from the trailing edge by a second distance, the second longitudinal edge and the second leading edge both being through slots and being connected to each other at one end thereof, the second connecting edge being an imaginary connecting line with one end connected to the second longitudinal edge and the other end connected to the second leading edge so as to form the triangular shaped second movable member;

wherein, the first distance is different from the second distance.

9. The swim fin of claim 8, wherein the fin blade further comprises two openings and two side ribs, each of the two openings is formed on an other edge of the fin blade for inserting one side rib in a removable manner;

wherein, when the side ribs are inserted in the openings, structural strength of the fin blade is increased; when the side ribs are removed from the openings, the fin blade is still functional for swim fin operation but in a more flexible manner.

10. The swim fin of claim 8, wherein one end of the first longitudinal edge is located near to the foot-packet formation, such that the first longitudinal edge is substantially extending from the foot-packet formation toward the trailing edge in a direction parallel to the imaginary center line.

11. The swim fin of claim 10, wherein a length of the first longitudinal edge is longer than ⅔ of the first length of fin blade.

12. The swim fin of claim 8, wherein each portion of the fin blade is further formed with at least one groove, the groove is located on an upper surface of the fin blade and is extending between the leading edge and the trailing edge for guiding water flows.

13. The swim fin of claim 8, wherein the fin blade has two longitudinal outer edges extending between the foot-packet formation and the trailing edge, each outer edge has a thickness greater than that of the fin blade for providing structural strength, each outer edge is further formed with a rudder at one end adjoining the trailing edge for guiding water flows.

* * * * *